United States Patent [19]

Alonso

[11] 4,279,185

[45] Jul. 21, 1981

[54] ELECTRONIC MUSIC SAMPLING TECHNIQUES

[76] Inventor: Sydney A. Alonso, Strafford, Vt. 05072

[21] Appl. No.: 804,363

[22] Filed: Jun. 7, 1977

[51] Int. Cl.[3] ..... G10H 1/00

[52] U.S. Cl. ..... 84/1.01; 84/1.03; 84/1.24; 84/1.11; 84/1.19

[58] Field of Search ..... 84/1.01, 1.03, 1.24, 84/1.26, 1.11, 1.19, 1.17; 364/728, 721

[56] References Cited

U.S. PATENT DOCUMENTS

| | | | |
|---|---|---|---|
| 3,610,799 | 10/1971 | Watson | 84/1.01 |
| 3,831,015 | 8/1974 | Hoff, Jr. | 84/1.01 X |
| 3,878,750 | 4/1975 | Kapps | 84/1.03 X |
| 3,894,463 | 7/1975 | Rocheleau | 84/1.01 |
| 3,982,460 | 9/1976 | Obayashi et al. | 84/1.03 |
| 4,023,454 | 5/1977 | Obayashi et al. | 84/1.01 |
| 4,070,942 | 1/1978 | Aoki | 84/1.01 |

OTHER PUBLICATIONS

Korn et al., "Electronic Analog and Hybrid Computers", p. 422, McGraw-Hill, Inc., 1964.

*Primary Examiner*—Ulysses Weldon
*Attorney, Agent, or Firm*—Robert Shaw

[57] ABSTRACT

The disclosure describes improved apparatus for sampling a digitally-stored waveshape only at a rate $2^N$ times the fundamental frequency of a note synthesized, where N is an integer. The apparatus includes a digital memory for storing a digital representation of the waveshape. A top octave synthesizer produces clock pulses at a rate $2^N$ times the fundamental frequency of a desired note. An octave oscillator generates addresses for the digital memory in response to at least some of the clock pulses depending on the octave in which the desired note is located. A digital-to-analog converter converts the output from the digital memory into an analog signal suitable for sound production.

13 Claims, 4 Drawing Figures

ELECTRONIC MUSIC SAMPLING TECHNIQUES

BACKGROUND AND SUMMARY OF THE INVENTION

This invention relates to electronic musical instruments or synthesizers and more particularly relates to such apparatus which stores a digital representation of a waveshape.

Electronic musical instruments are capable of producing audible musical notes from either analog or digital circuitry. The digital approach to sound production was described by Max V. Matthews in a paper entitled "An Acoustic Compiler For Music And Psychological Stimuli" published in the May, 1961 issue of The Bell Systems Technical Journal. Mathews describes the basic concept of storing a digital representation of a wave-shape and repetitiously reading the waveshape from the representation at a predetermined rate in order to produce a musical note.

The Mathews concept has been used in a variety of electronic musical instruments. For example, one adaptation of the concept used in connection with electronic organs is described in U.S. Pat. No. 3,515,792 (Deutsch-June 2, 1970). Both Mathews and Deutsch teach the concept of digitally representing the amplitude of a sound waveshape at a plurality of points representing arbitrary angles of the waveshape. The waveshape is then sampled at a variety of frequencies depending on the notes to be produced. Although the Deutsch and Mathews systems both result in usable sounds, they fail to take into account the alias distortion created when the digital amplitudes are stored at arbitrary phase angles and sampled at unrestricted frequencies. This alias distortion results from alias frequencies which are an unavoidable consequence of the act of sampling or desampling a signal, such as a stored wave-shape. Alias distortion is potentially intolerable: (a) if the alias frequency components occur within the low-passband of the output of a system due to sampling at too low a rate; (b) if the magnitudes of the alias frequency components are "too great"; (c) or, for musical purposes, if the alias frequency components move in a frequency direction opposed to the direction of the fundamental frequency of a note (e.g., an alias frequency moves lower in pitch as a desired fundamental note moves higher in pitch). Alias distortion also results from the inability of a digital number of finite length to represent an analog quantity with 100 percent precision. Accuracy improves as the length of the digital number increases, but in general, some small error remains. Although alias distortion is always present in a sampled signal, it has been discovered that the effect of the distortion in numerical systems can be minimized by sampling at $2^N$ times the desired fundamental frequency. The $2^N$ harmonically sampled signal will have alias products which occur at frequencies which are integer multiples of the fundamental. This means that if there were energy present at one of these harmonics in the desired wave, the effect of the aliased energy would likely go unnoticed by a human observer because it would be merely an augmentation or diminution of that desired harmonic's energy and would merely slightly change the timbre of the wave produced. If the frequency of the desired fundamental were changed, the alias products would move in the same direction, and, harmonically, there would always be less chance of their being noticed by a human listener. If a signal is sampled at other than $2^N$ times the fundamental, the alias components, in general, do not occur in integer multiples of the fundamental. This non-harmonic type of alias distortion is easier for a human ear to detect than harmonic type alias distortion due to psychoacoustic phenomena involving differential perceptions.

More specifically, it has been discovered that sound waves can be produced with improved fidelity and alias distortion can be minimized by sampling a stored waveshape only at a rate $2^N$ times the fundamental frequency of the note desired, where N is an integer which is varied to achieve control of the octave of the desired output wave. Likewise, the synthesis of a waveshape is improved by storing a digital representation of the amplitude of the waveshape at a plurality of phase angles, each phase angle being at $(2\pi X)/2^K$ radians, where X and K are integers. These two techniques also can be combined in order to more faithfully reproduce the waveshape stored in a digital manner.

DESCRIPTION OF THE DRAWINGS

These and other advantages and features of the present invention will hereafter apppear in connection with the accompanying drawings wherein.

DESCRIPTION OF THE PREFERRED EMBODIMENT

Figure 1:
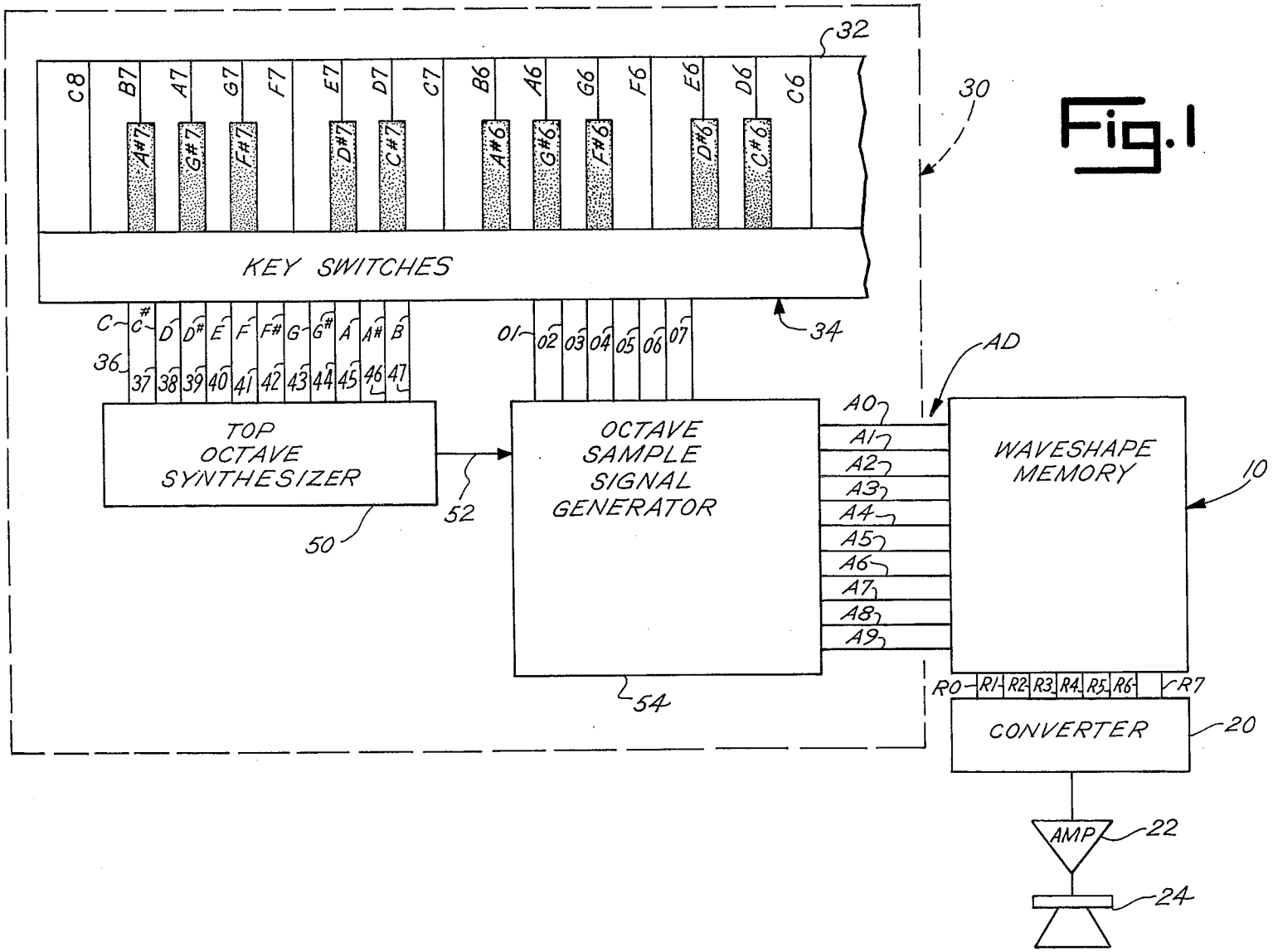
FIG. 1 is a fragmentary, schematic, block diagram of a preferred form of a musical instrument made in accordance with the present invention employing a waveshape memory and octave sample signal generator.
Figure 2:
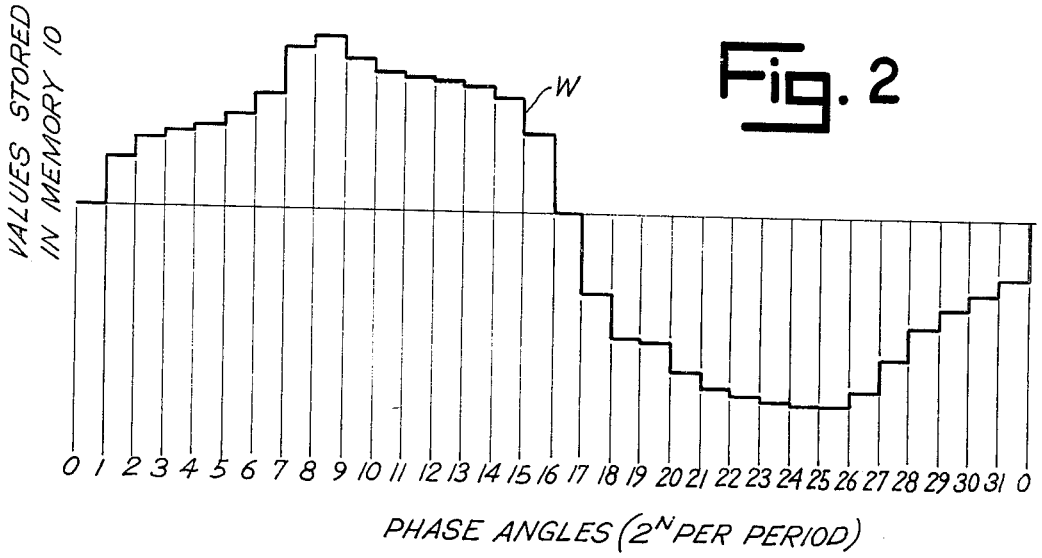
FIG. 2 is a waveform diagram illustrating a preferred means of storing a waveshape digitally in the waveshape memory.

Referrring to FIGS. 1 and 2, a preferred form of the system made in accordance with the invention includes a digital waveshape memory 10 for digitally storing a periodic waveshape W. Memory 10 preferably comprises a read-only memory capable of storing 1,024 8-bit words which represent 1,024 different amplitudes of waveshape W at 1,024 different, equally-spaced phase angles of a complete period of waveshape W.

An example of this storage technique is shown in FIG. 2 in which waveshape W corresponds to the harmonics or timbre of a sound to be produced. Of course, different sounds with different timbres can be produced by storing different values in memory 10 corresponding to different waveshapes. The waveshape is periodic and the entire period shown in FIG. 2 can be represented by $2\pi$ radians. According to the preferred embodiment of the invention, each of the 8-bit words stored in memory 10 represents an amplitude of waveshapes W at a phase angle of $(2\pi X)/2^K$ radians, where X is all integers between 0 and $2^K-1$ and where K is an integer. For the sake of simplicity, all of the 1,024 words stored for waveshape W are not shown in FIG. 2; rather, only 32 representative, equally-spaced, phase angles are illustrated. As a result, $K=5$ and $2^K=32$, the number of samples per period of the waveshape. The phase angles are located at $(2\pi X)/32$. For example, the phase angles 1–3 are located at $(2\pi)/32$, $(2\pi 2)/32$, and $(2\pi 3)/32$ radians, respectively. This is an important feature which results in the proper sampling of the waveshape in order to minimize distortion without unduly complicating the design of the pulse source by which the sampling is achieved.

For the case in which 1,024 words are stored to represent waveshape W, K=10, and the radians at which the amplitude signals are stored can be represented by $(2\pi X)/1{,}024$, where X is an integer. Each one of the 8-bit words stored in memory 10 can be addressed by placing the proper digital code on address conductors A0–A9 of address line AD. The address conductors are capable of representing 1,024 separate states. When the proper address for a word is placed on address line AD, the word is read out of the memory onto readout conductors R0–R7, and then is transmitted to a conventional converter 20.

Converter 20 comprises a digital-to-analog converter which transforms the digital words read from memory 10 into a corresponding analog signal. Converter 20 may include attack and decay envelope control circuitry as well as other control devices. Exemplary converter circuitry is shown in the above-identified Deutsch Patent as attack and decay control circuitry 26, summing means 28 and digital-to-analog converter 30.

Referring to FIG. 1, the analog tone signal produced by converter 20 is amplified by a conventional audio amplifier 22 and converted to a corresponding musical note by a conventional loudspeaker transducer 24.

Waveshape memory 10 includes an address decoder capable of interpreting the code placed on address line AD and reading the corresponding digital word from the memory. One exemplary memory is illustrated in detail in the above-identified Deutsch Patent.

Referring to FIG. 1, the preferred embodiment also includes a sampling system 30 for sampling the digital waveshape representation stored in memory 10. The waveshape is sampled by utilizing a plurality of the digital values stored in memory 10 which represent the waveshape. System 30 includes a conventional keyboard 32 comprising keys corresponding to notes C1–C8 of a piano keyboard. As those trained in the musical arts will appreciate, note C1 typically is tuned to 32 Hz. ($2^5$) and note C8 typically is tuned to 4,096 Hz. ($2^{12}$). For purposes of simplicity, only the two octaves from C6 to C8 are shown in FIG. 1. Each of these octaves includes 12 keys which represent the 12 notes of the equally-tempered chromatic scale.

Keyboard 32 operates a conventional key switch assembly 34 in which all like-lettered keys in various octaves are ganged together. As a result, the key switches produce note signals corresponding to the notes of the chromatic scale which are played on the keyboard. The note signals are transmitted over conductors 36–47 which correspond to notes C–B, respectively. For example, if a G in any octave is played, a note signal is transmitted over conductor 43. Likewise, if a D# in any octave is played, a note signal is transmitted over conductor 39.

Key switch assembly 34 also is capable of generating octave signals which correspond to the octave in which the keys are played. The octave signals are transmitted over conductors 01–07 corresponding to octaves 1–7, respectively. For example, if note C1 is played, an octave signal is transmitted over conductor 01. Likewise, if note E5 is played, an octave signal is transmitted over conductor 05.

Conductors 36–47 transmit note signals to a conventional top octave synthesizer 50. Such synthesizers are well known in the art and need not be described in detail. Basically, they rely on a high-frequency master oscillator and a series of dividers in order to produce clock pulses having repetition rates with ratios equal to multiples of the 12th root of 2, the same ratios separating the intervals of the equally-tempered chromatic scale. In the embodiment shown in FIG. 1, synthesizer 50 produces on conductor 52 clock pulses having any one of 12 repetition rates in the octave from 32,768–65,536 Hz. ($2^{15}-2^{16}$ Hz., respectively). Top octave synthesizers of the foregoing type are well known in the art. One example is described in connection with FIG. 3 of the above-identified Deutsch Patent. Alternatively, the note oscillator shown in the copending application, entitled "Musical Note Oscillator" filed contemporaneously herewith by the same inventor (now U.S. Pat. No. 4,108,035), may be substituted for top octave synthesizer 50. Whichever embodiment of top octave synthesizer is employed, the clock pulses on conductor 52 representing any one note should be equally time-spaced (i.e., have a uniform phase). In addition, the frequency of these clock pulses shall be $2^N$ times the frequency of the fundamental note to be produced. For example, in the present embodiment, in order to produce the note C8, having a fundamental frequency of $2^{12}$ Hz., the top octave synthesizer produces clock pulses having a frequency of $2^{16}$ Hz. (i.e., produces clock pulses having a frequency $2^4$ times the fundamental frequency of C8).

Figure 3:
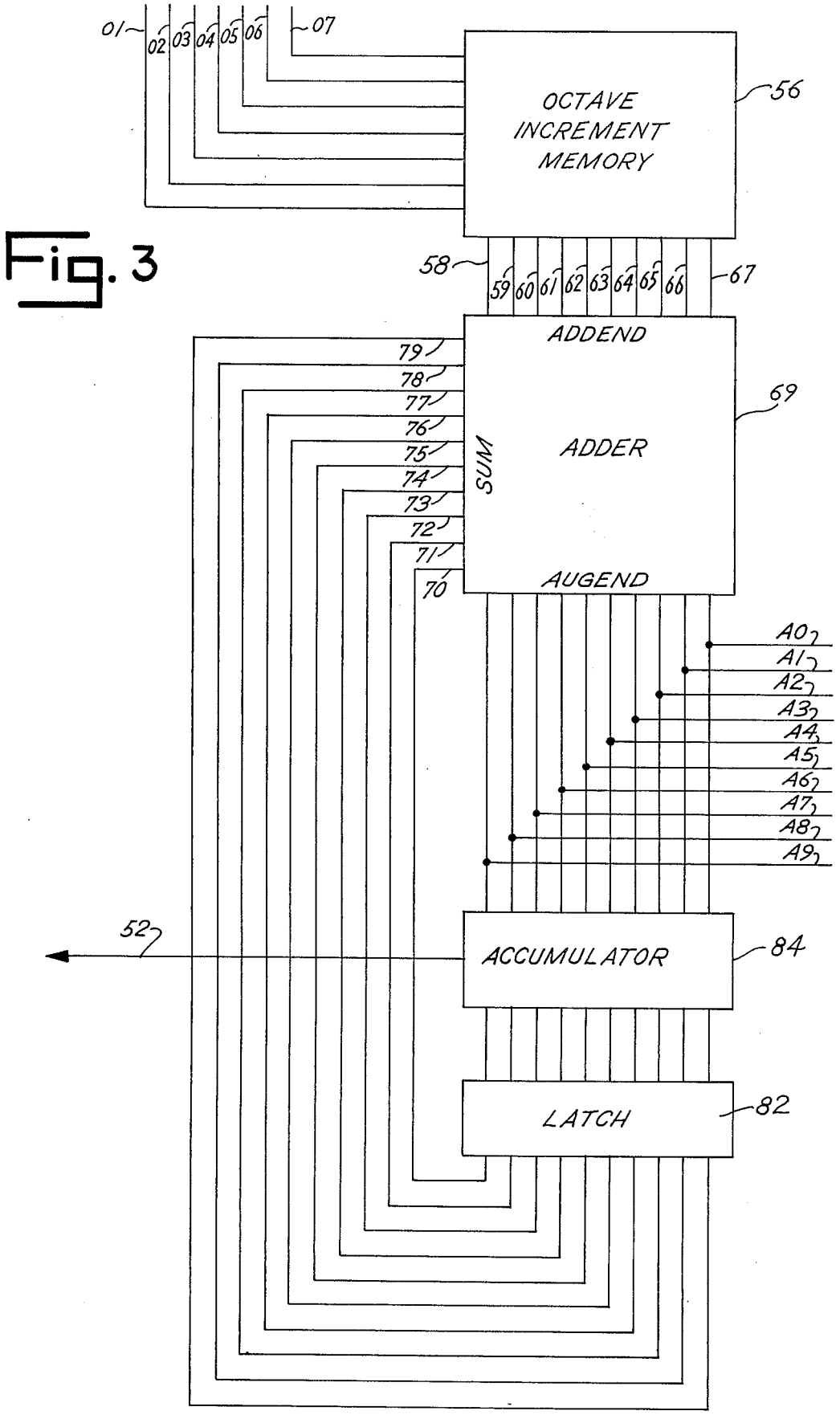
FIG. 3 is an electrical schematic diagram illustrating a preferred form of the octave sample signal generator.

The clock pulses produced by top octave synthesizer 50 are transmitted to an octave sample signal generator 54 which is shown in detail in FIG. 3. Generator 54 includes an octave increment read-only memory 56 which receives the octave signals from conductors 01–07. Memory 56 stores 8 different 10-bit digital octave increment numbers, one corresponding to each octave of keyboard 32. Whenever a key is played, an octave signal is received over one of conductors 01–07, and the corresponding octave increment number is read to output conductors 58–67.

The octave increment numbers are supplied to the addend input of a digital adder 69. In a well-known manner, the adder sums the 10-bit digital number appearing at its addend input with the 10-bit digital number appearing at its augend input in order to produce a sum on sum conductors 70–79. The augend to adder 69 is provided by sample signals corresponding to the addresses appearing on address conductors A0–A9. The sum is transmitted to a latch 82 and an accumulator 84 which temporarily stores the address numbers while memory 10 is being addressed. In response to each clock pulse on conductor 52, the adder sums the addend and augend numbers to form a new sample signal which corresponds to a new address for memory 10.

The operation of the octave sample signal generator is more particularly described in connection with Table A:

TABLE A

| Octave Number | Note Range | Octave Increment Number | Samples Per Period | Frequency Range |
|---|---|---|---|---|
| 1 | C1–C2 | $2^0$ | $2^{10}$ | $2^5$–$2^6$ |
| 2 | C2–C3 | $2^1$ | $2^9$ | $2^6$–$2^7$ |
| 3 | C3–C4 | $2^2$ | $2^8$ | $2^7$–$2^8$ |
| 4 | C4–C5 | $2^3$ | $2^7$ | $2^8$–$2^9$ |
| 5 | C5–C6 | $2^4$ | $2^6$ | $2^9$–$2^{10}$ |

TABLE A-continued

| Octave Number | Note Range | Octave Increment Number | Samples Per Period | Frequency Range |
|---|---|---|---|---|
| 6 | C6-C7 | $2^5$ | $2^5$ | $2^{10}$-$2^{11}$ |
| 7 | C7-C8 | $2^6$ | $2^4$ | $2^{11}$-$2^{12}$ |

The Octave Number and the Note Range columns in Table A refer to the octaves of keyboard 32 and the corresponding note range of the octaves. The Octave Increment Number column indicates the octave increment number read from memory 56 (FIG. 3) in order to produce a note in the indicated note range. The Samples Per Period column indicates the number of times the waveform W stored in memory 10 is sampled for each period of the waveform to be produced. The Frequency Range column indicates the frequency range in Hertz of the fundamentals of the musical notes produced in the corresponding octaves.

It should be noted that the number of samples read from memory 10 per period of waveform or waveshape W varies depending on the octave of the note being produced. In the lowest octave (i.e., octave number 1), all 1,024 words stored in memory 10 are read out during each period of waveshape W. The number of words read out of the memory per period of the waveform decreases until the top octave (octave number 7) is reached, at which point only 16 words are read out of memory 10 for each period of waveshape W. However, in each case, $2^N$ equally time-spaced samples are taken for each period of the waveshape to be produced; and N is any positive integer between 1 and K, inclusive.

Figure 4:
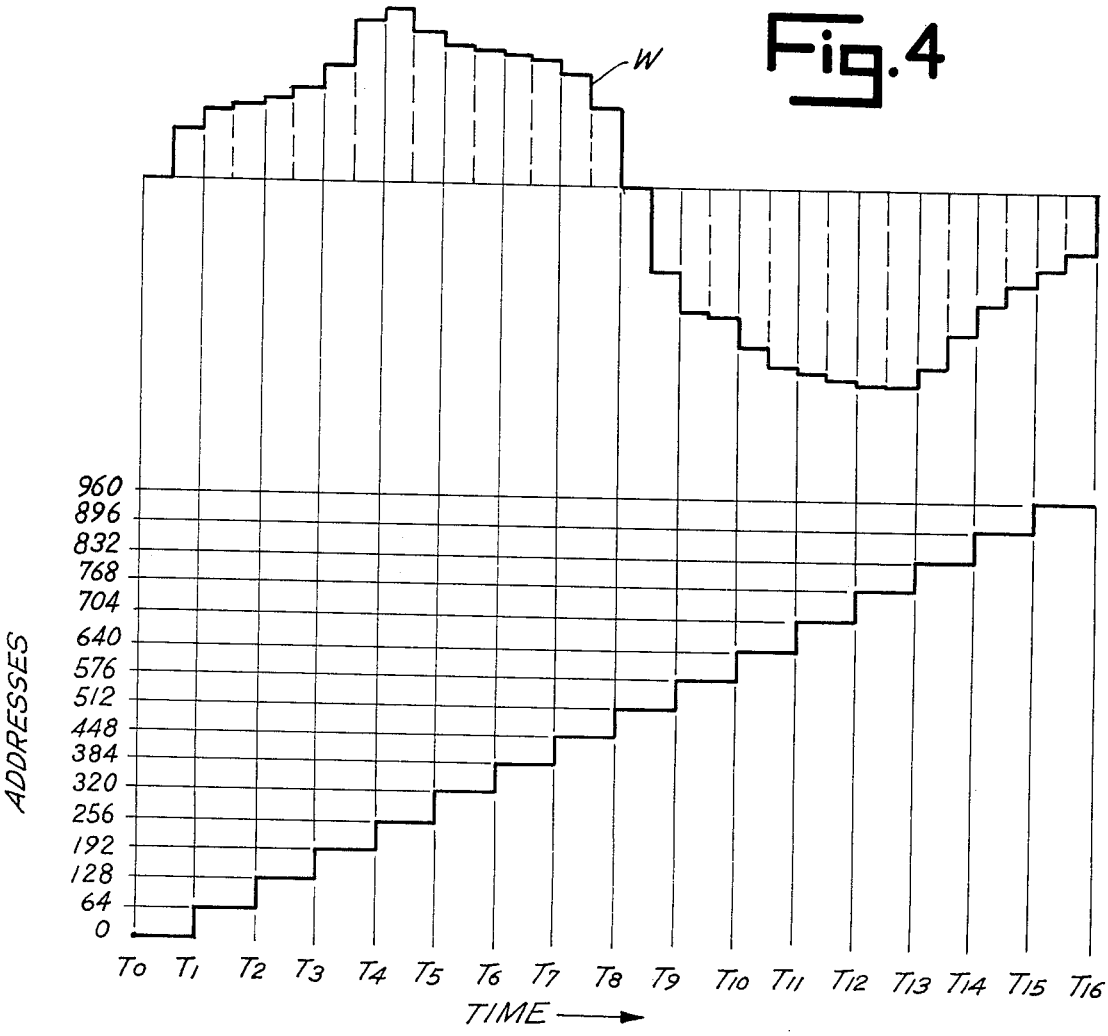
FIG. 4 is a waveshape diagram showing one method of sampling the stored waveform by the octave sample signal generator.

The overall operation of the instrument is more fully understood from the example described in FIG. 4 in which note C8 is produced. As soon as the performer depresses C8 on keyboard 32, a note signal is transmitted over conductor 36 to top octave synthesizer 50, and an octave signal is transmitted over conductor 07 to octave sample signal generator 54 (FIG. 1). In response to the note signal, synthesizer 50 produces a series of clock pulses at a rate of $2^{16}$ Hz. These clock pulses appear at times T0–T16 (FIG. 4). In response to the octave signal, the octave increment number $2^6$ is read out of memory 56 onto conductors 58–67 (FIG. 3). In response to each clock pulse on conductor 52, adder 69 adds $2^6$ to the address appearing on conductors A0–A9 and the sum is stored in accumulator 84. The manner in which the sums accumulate at each of times T0–T16 is shown on the vertical axis of FIG. 4. As each address is generated, the corresponding digital word is read out of waveshape memory 10, and the words are converted to an audible musical note. It should be noted that only the digital words of memory 10 corresponding to the addresses identified in FIG. 4 are read out for each period of waveshape W. These words have values corresponding to the amplitude of the solid lines shown in connection with waveshape W in FIG. 4. The other words stored in memory 10, including those corresponding to the dotted lines shown under curve W in FIG. 4, are not read out of memory 10.

It has been found that only a portion of the 1,024 words stored in memory 10 need be read out for any waveshape period in order to produce a substantially distortion-free musical note. As long as the waveshape stored in the memory is sampled at $2^N$ times the fundamental frequency of the note, and a reasonable number of samples is taken per period, the distortion remains at an acceptably low level.

Those skilled in the art will recognize that the single embodiment of the invention described herein may be altered and modified without departing from the true spirit and scope of the invention as defined in the accompanying claims.

What is claimed is:

1. Apparatus for generating a tone signal suitable for conversion to a corresponding audible musical note having a fundamental frequency and a predetermined waveshape, comprising:

waveshape means for storing a binary digital representation of the waveshape, said waveshape being periodic, an entire period of the waveshape being represented by $2\pi$ radians, the amplitude of the waveshape being digitally represented at each of a plurality of $2^K$ phase angles, each phase angle being at $(2\pi X)/2K$, where X is all integers between 0 and $2^K-1$ and where K is an integer;

means for sampling the waveshape only at a rate equal to $2^N$ times the fundamental frequency of the musical note, where N is an integer; and means for converting the results of the sampling into a tone signal having the fundamental frequency, whereby distortion of a resulting musical note is reduced.

2. Apparatus, as claimed in claim 1, wherein the waveshape means comprises means for digitally representing the amplitude of the waveshape at a plurality of phase angles.

3. Apparatus, as claimed in claim 1, wherein the means for sampling comprises means for taking $2^N$ equally time-spaced samples for each period of the waveshape to be represented.

4. Apparatus, as claimed in claim 1, wherein the means for sampling comprises:

input means for generating a note signal corresponding to the chromatic note to be produced and for generating an octave signal corresponding to the octave in which the chromatic note is located;

digital oscillator means responsive to the note signal for generating clock pulses having a repetition rate equal to said $2^N$ times the fundamental frequency of the musical note;

octave means responsive to the octave signal for producing sample signals having a repetition rate equal to the repetition rate of said clock pulses; and means for sampling the waveshape at a different one of said phase angles in response to each sample signal.

5. Apparatus, as claimed in claim 4, wherein the waveshape means comprises a digital memory for storing waveshape amplitude information at a plurality of addresses, each address corresponding to a phase angle of the waveshape and wherein the octave means comprises:

accumulator means for temporarily storing a sampling signal corresponding to an address of the digital memory;

octave memory means for storing a plurality of octave increment numbers, each octave increment number corresponding to an octave in which a musical note is to be played, and for transmitting one of the octave increment numbers to the output terminals in response to the octave signal; and adder means responsive to each clock pulse for adding the value of the octave increment number present at the output terminals to the value of the sampling signal stored in the accumulator means to create a sum sample signal and for storing the sum sample signal in the accumulator means to replace the sampling signal.

6. A method of producing an audible musical note having a fundamental frequency and a predetermined waveshape comprising the steps of:

storing a binary digital representation of the waveshape;

sampling the waveshape only at a rate $2^N$ times the fundamental frequency of the note where N is an integer; and converting the results of the sampling into the musical note, whereby distortion of the musical note is reduced.

7. A method as claimed in claim 6, wherein the step of storing comprises the step of digitally representing the amplitude of the waveshape at a plurality of phase angles.

8. A method, as claimed in claim 6, wherein the waveshape is periodic and wherein the step of storing further comprises the steps of:

representing an entire period of the waveshape by $2\pi$ radians; and digitally representing the amplitude of the waveshape at a plurality of $2^K$ phase angles, each phase angle being at $(2\pi X)/2^K$ radians where X is all integer numbers between 0 and $2^K-1$ and where K is an integer.

9. A method, as claimed in claim 6, wherein the step of sampling comprises the step of taking $2^N$ equally time-spaced samples for each period of the waveshape to be represented.

10. An electronic musical instrument comprising:

key means for selecting a musical note having a fundamental frequency and a predetermined waveshape;

waveshape means for storing a digital representation of the waveshape, said waveshape being periodic, an entire period of the waveshape being represented by $2\pi$ radians, the amplitude of the waveshape being digitally represented at a plurality of $2^K$ phase angles, each phase angle being at $(2\pi X)/2^K$ radians, where X is all integers between 0 and $2^K-1$ and where K is an integer;

means for sampling the waveshape only at a rate equal to said $2^N$ times the fundamental frequency of the note, where N is an integer; and means for converting the results of the sampling into an audible musical note having the fundamental frequency, whereby distortion of the musical note is reduced.

11. An instrument, as claimed in claim 10, wherein the means for sampling comprises means for taking $2^N$ equally time-spaced samples for each period of the waveshape to be represented.

12. An instrument, as claimed in claim 10, wherein the key means comprises:

means for generating a note signal corresponding to the chromatic note to be produced and for generating an octave signal corresponding to the octave in which the chromatic note it located;

digital oscillator means responsive to the note signal for generating clock pulses having a repetition rate equal to said $2^N$ times the fundamental frequency where N is an integer between 1 and K inclusive;

octave means responsive to the octave signal for producing sample signals having a repetition rate equal to the repetition rate of the clock pulses; and means for sampling the waveshape at a different one of said phase angles in response to each sample signal.

13. An instrument, as claimed in claim 12, wherein the waveshape means comprises a digital memory for storing waveshape amplitude information at a plurality of addresses, each address corresponding to a phase angle of the waveshape and wherein the octave means comprises:

accumulator means for temporarily storing a sampling signal corresponding to an address of the digital memory;

octave memory means for storing a plurality of octave increment numbers, each octave increment number corresponding to an octave in which a musical note is to be played, and for transmitting one of the octave increment numbers to the output terminals in response to the octave signal; and adder means responsive to each clock pulse for adding the value of the octave increment number present at the output terminals to the value of the sampling signal stored in the accumulator means to create a sum sample signal and for storing the sum sample signal in the accumulator means.

* * * * *